US010077125B2

(12) United States Patent
Wildes et al.

(10) Patent No.: US 10,077,125 B2
(45) Date of Patent: Sep. 18, 2018

(54) BALE TIE-OFF ACCELERATOR CHAMBERS AND METHODS

(71) Applicant: Charles Sidney Wildes, Saint Simons Island, GA (US)

(72) Inventors: Charles Sidney Wildes, Saint Simons Island, GA (US); Gus C. Koufonikos, Jr., Jacksonville, FL (US); Ken Thomas, Jacksonville, FL (US)

( * ) Notice: Subject to any disclaimer, the term of this patent is extended or adjusted under 35 U.S.C. 154(b) by 0 days.

(21) Appl. No.: 15/313,389

(22) PCT Filed: May 19, 2016

(86) PCT No.: PCT/US2016/033307

§ 371 (c)(1),
(2) Date: Nov. 22, 2016

(87) PCT Pub. No.: WO2016/187444

PCT Pub. Date: Nov. 24, 2016

(65) Prior Publication Data

US 2017/0190450 A1 Jul. 6, 2017

Related U.S. Application Data

(60) Provisional application No. 62/163,611, filed on May 19, 2015.

(51) Int. Cl.

| | |
|---|---|
| ***B65B 13/04*** | (2006.01) |
| ***B65B 13/20*** | (2006.01) |
| ***B65B 13/26*** | (2006.01) |
| ***B30B 9/30*** | (2006.01) |
| ***B65B 13/02*** | (2006.01) |

(Continued)

(52) U.S. Cl.

CPC ..... *B65B 13/04* (2013.01); *B30B 9/30* (2013.01); *B30B 9/3003* (2013.01); *B65B 13/02* (2013.01); *B65B 13/06* (2013.01); *B65B 13/18* (2013.01); *B65B 13/20* (2013.01); *B65B 13/26* (2013.01); *B65B 27/12* (2013.01); *B65B 63/00* (2013.01)

(58) Field of Classification Search

CPC ..... B65B 13/02; B65B 13/04; B65B 13/06; B65B 13/18; B65B 13/20; B65B 13/26; B65B 27/12; B65B 63/00; B30B 9/3003; B30B 9/30; A01F 15/14

See application file for complete search history.

(56) References Cited

U.S. PATENT DOCUMENTS 2,760,617 A * 8/1956 Bowen ..... B65G 13/12 193/35 TE
4,090,440 A * 5/1978 Jensen ..... A01F 15/005 100/188 R (Continued)

*Primary Examiner* — Jimmy T Nguyen
(74) *Attorney, Agent, or Firm* — Jonathan Rigdon Smith, J.D., PC; Jonathan R. Smith

(57) ABSTRACT

A bale tie-off accelerator chamber receives bales from the compression chamber of a baler, keeps them compressed and ties them while a new bale is being compressed. The time required to make a bale using the prior art includes the time it takes to push the material into the pressure chamber and then stepwise apply ties to the bale as it is ejected. The present invention allows the complete freshly-compacted bale to be ejected from the pressure chamber before ties are applied, thus allowing the next bale to be formed without waiting for stepwise tying of the preceding bale.

9 Claims, 8 Drawing Sheets

(51) Int. Cl.

| | |
|---|---|
| ***B65B 13/06*** | (2006.01) |
| ***B65B 13/18*** | (2006.01) |
| ***B65B 27/12*** | (2006.01) |
| ***B65B 63/00*** | (2006.01) |

(56) References Cited

U.S. PATENT DOCUMENTS 4,936,206 A * 6/1990 Miles ..... B30B 9/3003
100/14
5,001,974 A * 3/1991 Gombos ..... A01F 15/005
100/14
5,694,742 A * 12/1997 Elliott ..... B30B 9/301
100/218
6,085,486 A * 7/2000 Hunter ..... B30B 9/3007
100/17

* cited by examiner

BALE TIE-OFF ACCELERATOR CHAMBERS AND METHODS

CROSS-REFERENCES TO RELATED APPLICATIONS

This application claims priority to PCT application no. PCT/US16/33307 filed May 19, 2016, which in turn claims priority to U.S. provisional application No. 62/163,611, filed Jun. 1, 2015.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A BIOLOGICAL SEQUENCE LISTING

Not applicable.

BACKGROUND OF INVENTION

Field of the Invention

This invention is in the field of compacting and baling materials for additional handling. More specifically it is in the field of maintaining the shape and compactness of bales of recycled material and preventing such bales from shedding material after they are compacted. Still more specifically, it is in the field of improving the speed and efficiency of the baling and bale tying processes.

Description of the Related Art

Typical two-ram balers have an upward-facing charging hopper into which the material to be baled is dumped. A first hydraulic gathering ram pushes the material to be baled from a gathering chamber under the hopper into a pressure chamber to produce a substantially rectangular solid compacted bale. A second hydraulic ejector ram at right angles to the first ram pushes the compacted bale through a tier and out onto a bale table. As the bale is pushed through the tier, the ejector ram stops at intervals to allow a wire or strap to encircle the bale and be tied off.

BRIEF DESCRIPTION OF THE INVENTION

Objects of the Invention

The time required to make a bale using the aforementioned baler includes the time it takes to push the material into the pressure chamber and then stepwise apply ties to the bale as it is ejected. Assuming the supply of material is not a limiting factor, this time line limits the production rate of the baler. There has thus been a long-felt need for a way to reduce this cycle time.

SUMMARY OF THE INVENTION

The present invention allows the freshly-compacted bale to be ejected essentially completely from the pressure chamber before ties are applied, thus allowing the next bale to be formed without waiting for stepwise tying of the preceding bale.

DETAILED DESCRIPTION OF THE INVENTION

Figure 1:
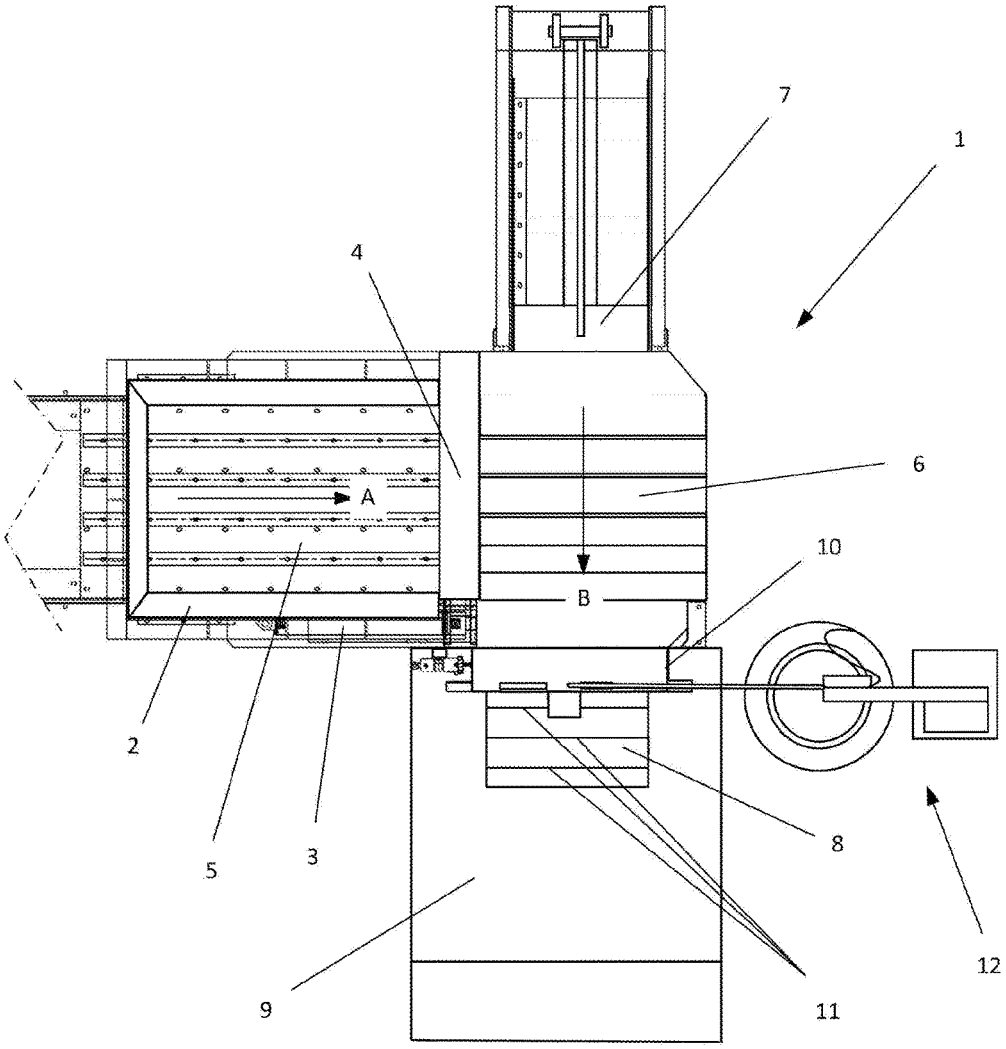
FIG. 1 PRIOR ART
FIG. 1 is a top view of a prior art baler.

Referring now to the drawings, in which like reference characters refer to like elements among the drawings, FIG. 1 shows a top view of a prior art baler 1. It is a two-ram baler have an upward-facing charging hopper 2 into which the material to be baled (not shown) is dumped. A first hydraulic cylinder 3 drives a gathering ram 4 in direction A to push the material from a gathering chamber 5 under the hopper 2 into a pressure chamber 6 where the pressure of the gathering ram 4 compacts the material. A second hydraulic ejector ram 7 at right angles to the first ram 4 pushes the compacted bale 8 in direction B out onto a bale table 9 through a tier 10. As the bale 8 is ejected through the tier 10, it stops at intervals to allow a wire or strap 11 to encircle the bale and be tied off. A wire or strap feeder stand 12, which supplies ties to the apparatus, is also shown.

Figure 2:
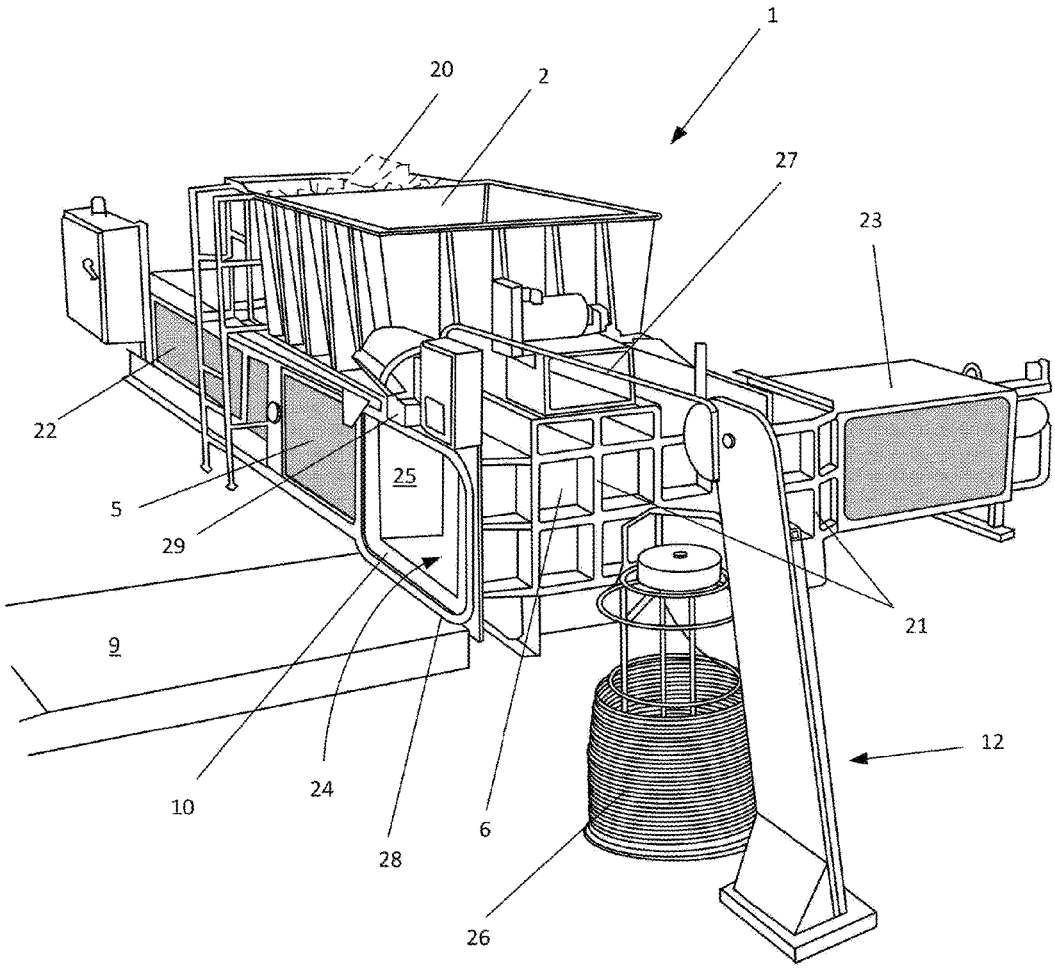
FIG. 2 PRIOR ART
FIG. 2 is an oblique view of the prior art baler.

FIG. 2 is an oblique view of the prior art baler 1. This view shows some material 20 waiting to be placed into hopper 2 for processing into bales. Gathering chamber 5 is visible below hopper 2. Pressure chamber 6 equipped with stiffeners 21 is shown in front of gathering chamber 5 in this view. Behind gathering chamber 5 in this view can be seen a gathering ram housing 22. At right angles to this housing is the ejector ram housing 23. At the left side in this view of pressure chamber 6 is ejection port 24. One side of the ejection port door 25 can also be seen within ejection port 24. A wire stand 12 is seen here farther in front of pressure chamber 6. Strapping material, in this case baling wire 26, is pulled from the wire stand 12 through a feeder tube 27 by the tier 10, which causes the wire to encircle a bale (not shown) in a tier frame 28. The tier 10 also has a mechanism 29 for twisting the wire around itself and cutting it off. The bale table 9 is visible in this view to the left of the tier 10.

Figure 3:
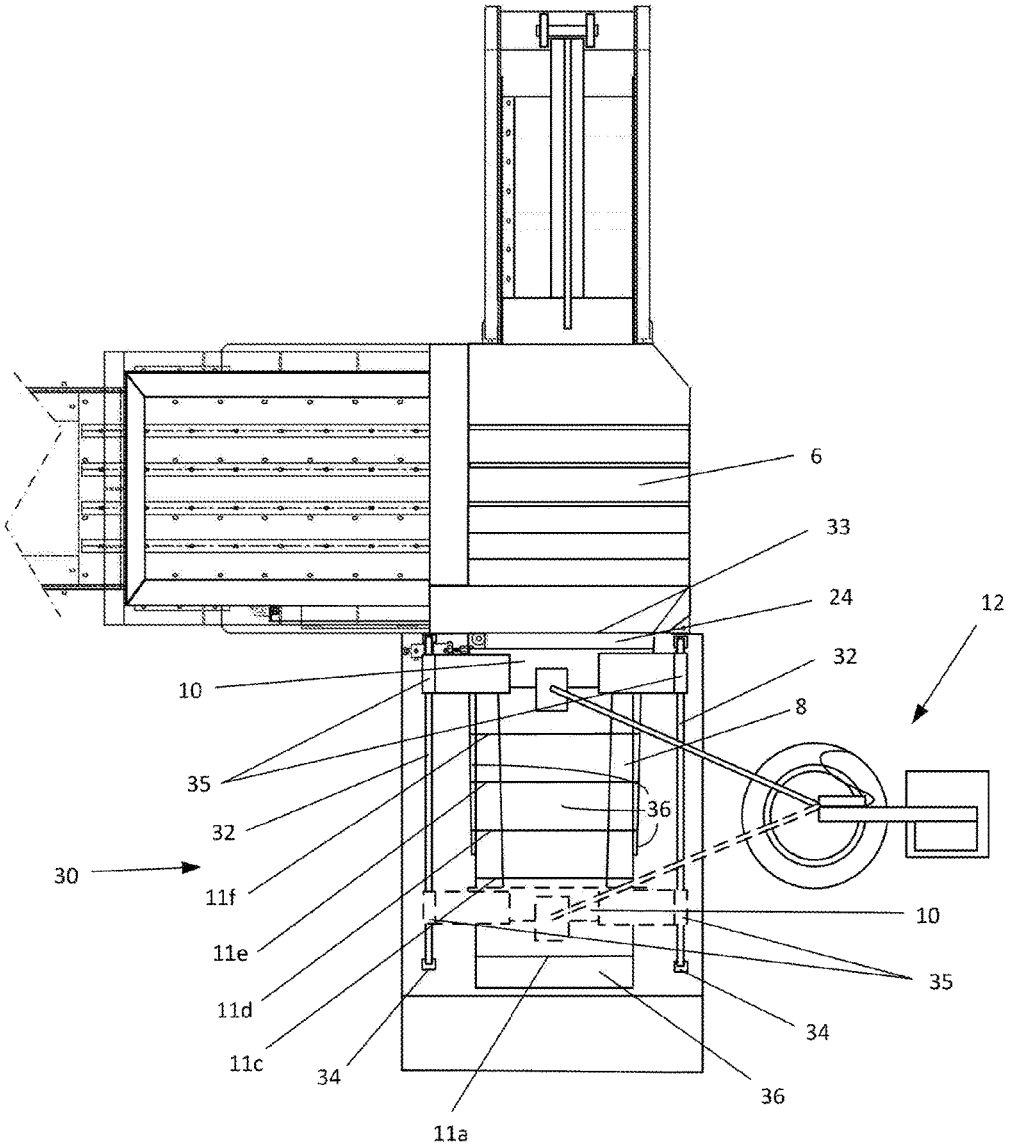
FIG. 3 is a top view of the baler of the first preferred embodiment of the present invention.

FIG. 3 is a top view of an accelerator chamber 30 of the first preferred embodiment of the present invention. It can be built into the prior art baler or made, in embodiments, as a stand-alone device. All of the parts seen in this view above and/or to the left of the pressure chamber 6 are the same as depicted in FIGS. 1 and 2. What is new here is shown in an accelerator chamber 30 built into the prior art baler 1 (see FIGS. 1 and 2). It consists of left and right tier rails 32 supported at their proximal ends by the upper edge 33 of pressure chamber 6 and at their distal ends by rail stands 34. The tier 10 is suspended between the rails 32 on glides 35 which allow the entire tier 10 to move toward and away from pressure chamber 6. This view shows wires 11 already applied to bale 8, but before they are all applied, a first wire 11*a* is applied by the tier 10 as bale 8 first emerges from ejection port 24 (only the top edge of which is shown here). This holds the bale distal end 36 together while the entire bale 8 is pushed out (downwardly in this view) and the ejection port doors (not visible here; see feature 25 in FIG. 2) close. This allows a new charge of material to be compacted in the pressure chamber 6 while the tying operation takes place. Paddles 37, attached at their proximal ends to ejection port 24, hold the sides, top and bottom of the bale 8 in place while tier 10 applies the remainder of the wires 11 to the bale. (In this view, the bottom paddle is hidden by the bale.) In embodiments, paddles 37 may be extensible in the distal direction to accommodate bales of different lengths.

In the first preferred embodiment of the method, the second wire 11*b* (hidden by tier 10 in dashed lines) is applied as soon as the bale 8 leaves the baler. Tier 10 is then indexed toward the ejection port 24, applying wires 11*c*-11*f* in succession while the bale 8 remains motionless. Wire 11*g* is here being applied by tier 10 adjacent to the ejection port 24 and is therefore not visible. Note that wire stand 12 is positioned on the floor roughly between the extreme positions of tier 10.

Figure 4:
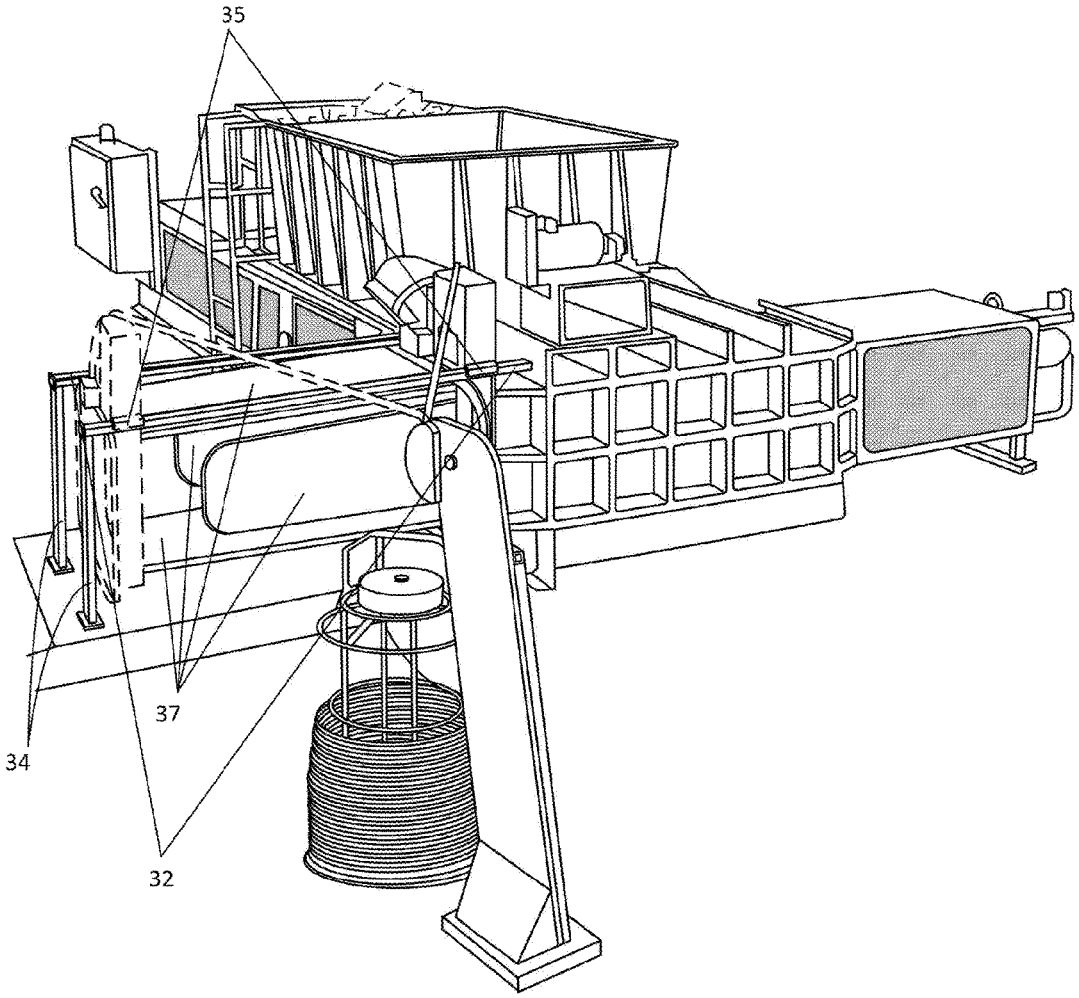
FIG. 4 is an oblique view of the baler of the first preferred embodiment of the present invention.

FIG. 4 is an oblique view of the baler of the first preferred embodiment of the present invention. No bale is present in this view. It gives a better picture of bale holding paddles 37, rails 32, rail stands 34, and glides 35. Instead of having two rails 32 from which the tier 10 is suspended, it is possible in embodiments within the scope of this invention to use rails projecting from the bottom of the pressure chamber 6, or four rails top and bottom. It is also within the scope of this invention in embodiments to put a wheeled undercarriage on the tier that runs on floor tracks or grooves, or other means of positioning tier 10 at desired wire placement points along a bale 8.

Balers are equipped with varying degrees of control over output bale parameters such as dimensions and density. In another embodiment of the present invention, one or more of paddles 37 may be extensible in the direction away from the baler so as to accommodate longer bales. For balers having automated control over bale length, extension of one or more paddles can be coordinated with baler length settings. Similarly, it is possible within the scope of this invention to manually or automatically set the spacing between the paddles 37 to match the cross-section of the bale being produced.

To maximize the bale output rate using this invention, it is highly desirable to adjust and index the wire spacing automatically. One way to do this in an embodiment of the present invention is to attach a toothed rack to the top of the tier 10 that extends from the outermost position of the tier 10 to a fixed point on the baler such as the pressure chamber 6, and drive it with a pinion that can be programmed to move the tier along the rails relative to the bale to place ties at any desired intervals.

Figure 5:
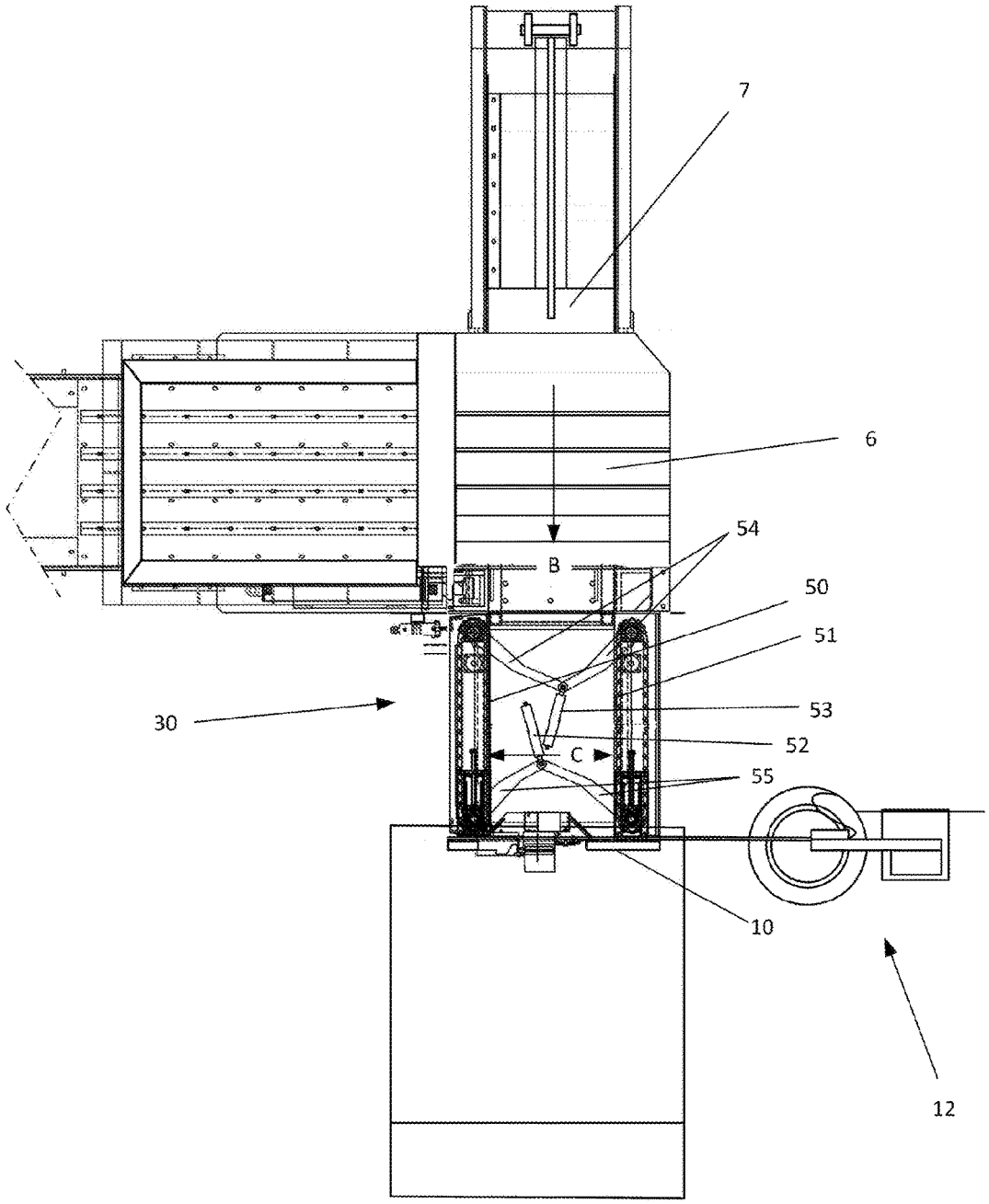
FIG. 5 is a top view of the baler of the second preferred embodiment of the present invention in a narrow configuration.

FIG. 5 is a top view of the baler of the second preferred embodiment of the present invention. This second preferred embodiment is like the first preferred embodiment in that it also saves time by tying each bale after it is ejected from the pressure chamber 6. It is different from the first preferred embodiment, however, in that instead of moving a tier along the length of the ejected bale while the ejected bale itself is held by paddles, this second preferred embodiment accelerator chamber 30 allows the baler's ejector ram 7 to push a compacted bale (not shown in this view) into accelerator chamber 30 without stopping, and retract. Another distinction between this embodiment and the first is that it can strap bales of varying widths. This accelerator chamber 30 has left and right endless vertical rolling walls 50 and 51, respectively, that catch the lead end of a bale (not shown in this view) as it emerges from pressure chamber 6, grip the bale, and move it in direction B in this view. In this second preferred embodiment, tier 10 is stationary at the end (bottom end in this view) of accelerator chamber 30.

To accommodate bales of varying widths, left rolling wall 50 of accelerator chamber 30 is movable towards and away (horizontally in this view) from right rolling wall 51. By working example, a way to accomplish this is through the use of left and right hydraulic cylinders 52 and 53, respectively, acting on front and rear dividers 54 and 55, respectively. In embodiments, this invention may utilize other means without limitation for setting the spacing between the rolling walls. In this figure, hydraulic cylinders 52 and 53 are shown retracted so as to pull front and rear dividers 54 and 55 towards each other. This pulls rolling walls 50 and 51 towards each other, establishing a narrow spacing C between the walls.

Figure 6:
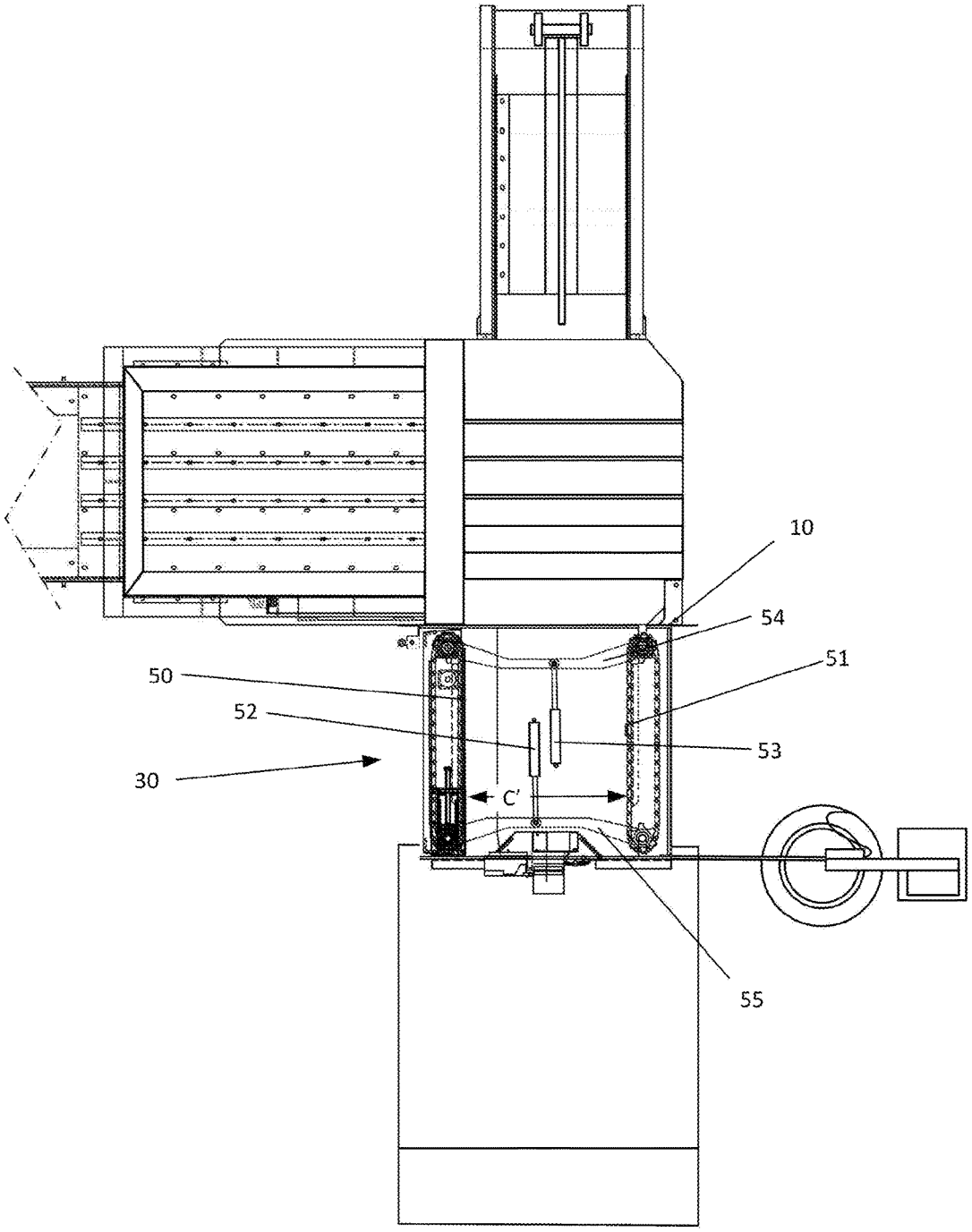
FIG. 6 is a top view of the baler of the second preferred embodiment of the present invention in a wide configuration.

FIG. 6 is a top view of the baler of the second preferred embodiment of the present invention in a wide configuration. Here, left and right hydraulic cylinders 52 and 53 are extended, pushing front and rear dividers 54 and 55 away from each other. This motion moves left rolling wall 50 of accelerator chamber 30 away from right rolling wall 51 to a wider spacing C'.

Figure 7:
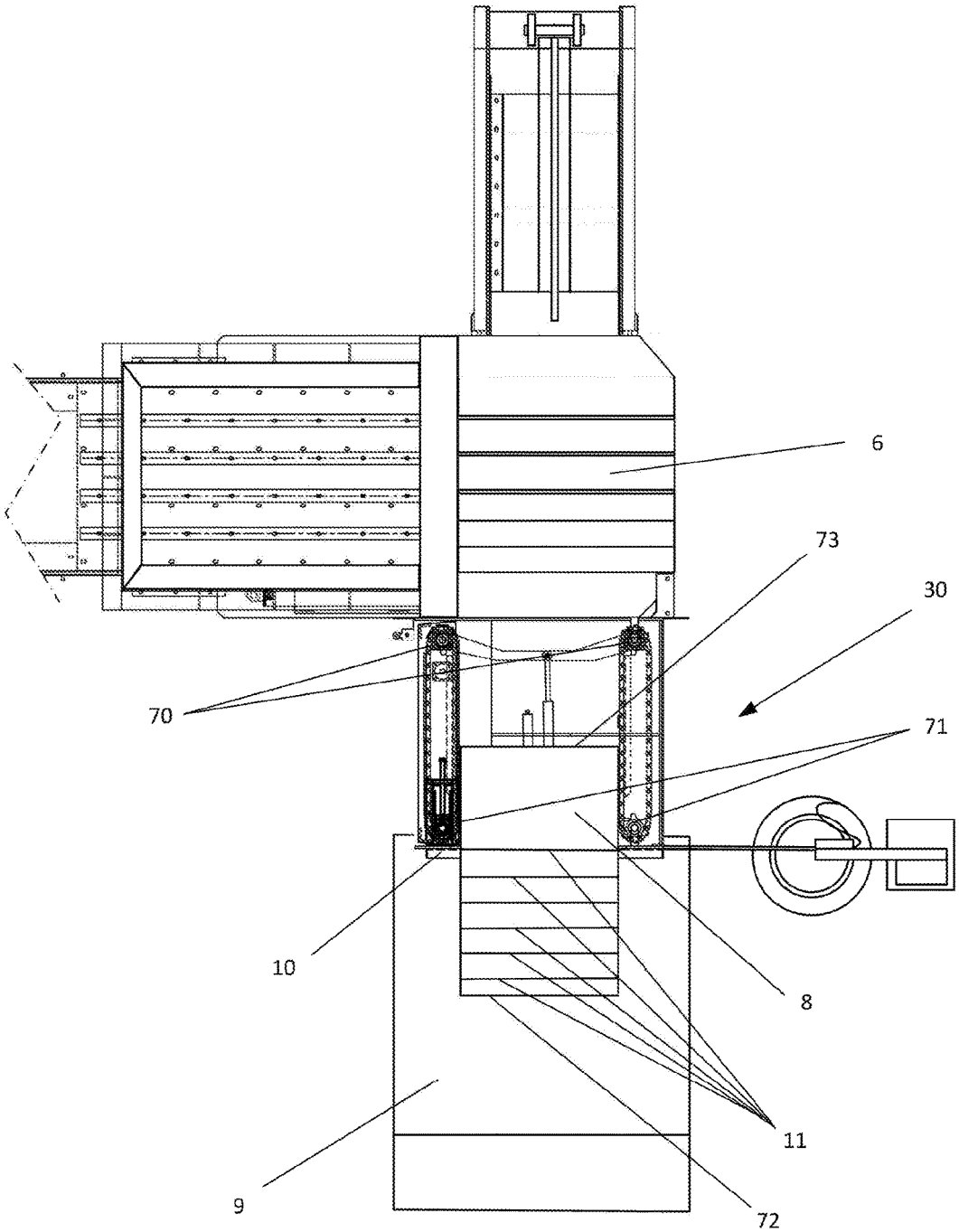
FIG. 7 is a top view of the baler of the second preferred embodiment of the present invention tying a wide bale.

FIG. 7 is a top view of the baler of the second preferred embodiment of the present invention tying a wide bale 8. Tier 10 has applied five tie wires 11 as bale 8 has been pushed through tier 10 by rolling walls 50 and 51, respectively. Meanwhile, a new bale (not visible) is being compacted in pressure chamber 6.

Preferably, a biasing mechanism is employed to force left rolling wall 50 towards right rolling wall 51 while they are rolling so as to squeeze the bale while the straps or wires are being applied. In a working but not limiting example, the rolling walls are endless belts driven by two drive sprockets 70 at one end of accelerator chamber 30, each held at the other end by idler sprockets 71. In a working but not limiting example, rolling walls 50 and 51 freewheel against bale 8 while it is first ejected into accelerator chamber 30, and then be driven to a point where the front bale end 72 is a certain distance through tier 10. Subsequently, the rolling walls 50 and 51 move stepwise through tier 10, stopping as each wire 11 is tied around bale 8. When the rear bale end 73 of the bale reaches a certain distance rearward of the tier, the rolling walls eject the bale onto bale table 9. By functional example and not by limitation, this second preferred embodiment of accelerator chamber 30 is powered by a 10 hp motor and pump, with timing sequencing provided by a Micrologix 1100 PLC.

Figure 8:
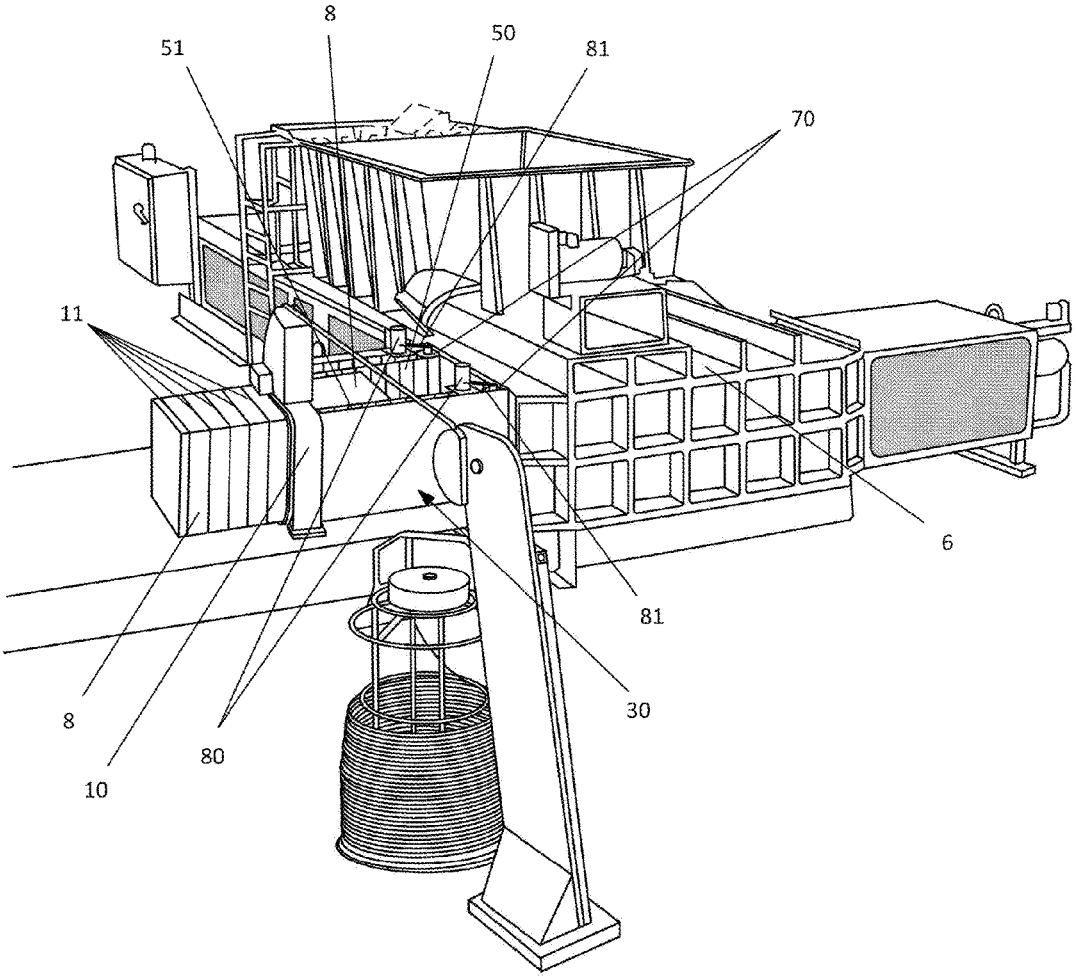
FIG. 8 is an oblique view of the baler of the second preferred embodiment of the present invention tying a wide bale.

FIG. 8 is an oblique view of the baler of the second preferred embodiment accelerator chamber 30 of the present invention tying a wide bale. Here, bale 8 is shown part-way through tier 10 after having five wires 11 tied around it. Endless vertical rolling walls 50 and 51 can be seen here from an oblique angle. Rolling wall drive motors 80 are shown connected by v-belts 81 to drive sprockets 70.

The invention claimed is:

1. A bale tie-off apparatus, comprising:

an accelerator chamber for receiving a bale in a discharge direction from a pressure chamber of a baler;

the accelerator chamber having an insert end proximate to the pressure chamber and a discharge end distal from the pressure chamber;

a bale tier that applies bale ties around the bale in a plane perpendicular to the discharge direction;

the bale tier comprising means for tying the bale after it is discharged from the baler pressure chamber;

the accelerator chamber comprising:

at least one pair of walls positioned oppositely to one another and separated from each other by a width, the at least one pair of walls gripping said bale as said bale is discharged from said pressure chamber; and the at least one pair of walls comprising means for moving the walls parallel to said discharge direction.

2. The apparatus of claim 1, in which:

said width is adjustable.

3. The apparatus of claim 2, wherein:

each of said means for moving said walls comprises an endless belt held by at least one drive sprocket.

4. The apparatus of claim 2, wherein:

said means for moving the walls comprises at least one motor actuated by at least one programmable controller.

5. The apparatus of claim 1, wherein:

said means for tying a bale is positioned at said discharge end.

6. A method for tying off bales, using a bale tie-off apparatus comprising: an accelerator chamber for receiving a bale in a discharge direction from a pressure chamber of a baler, the accelerator chamber having an insert end proximate to the pressure chamber and a discharge end distal from the pressure chamber, a bale tier that applies bale ties around the bale in a plane perpendicular to the discharge direction, the bale tier comprising means for tying the bale after it is discharged from the baler pressure chamber, the accelerator chamber comprising: at least one pair of walls positioned oppositely to one another and separated from each other by a width, the at least one pair of walls gripping said bale as said bale is discharged from said pressure chamber, and the at least one pair of walls comprising means for moving the walls parallel to said discharge direction, the method comprising the steps of:

(a) pushing a compacted bale out of said baler pressure chamber into said insert end of said accelerator chamber;

(b) actuating said means for moving the walls to grip said bale;

(c) actuating said means for moving the walls to move said bale into a first tie position beyond said discharge end;

(d) actuating said means for tying a bale;

(e) optionally actuating said means for moving the walls to move said bale into a subsequent tie position beyond said discharge end.

7. The method of claim 6, further comprising an additional step of:

(f) actuating said means for moving the walls to eject said bale from said accelerator chamber.

8. A method for tying off bales, using a bale tie-off apparatus comprising: an accelerator chamber for receiving a bale in a discharge direction from a pressure chamber of a baler, the accelerator chamber having an insert end proximate to the pressure chamber and a discharge end distal from the pressure chamber, a bale tier that applies bale ties around the bale in a plane perpendicular to the discharge direction, the bale tier comprising means for tying the bale after it is discharged from the baler pressure chamber, the accelerator chamber comprising: at least one pair of walls positioned oppositely to one another and separated from each other by a width, the at least one pair of walls gripping said bale as said bale is discharged from said pressure chamber, and the at least one pair of walls comprising means for moving the walls parallel to said discharge direction, wherein said width is adjustable, the method comprising the steps of:

(a) pushing a compacted bale out of said baler pressure chamber into said insert end of said accelerator chamber;

(b) actuating said means for moving the walls to grip said bale;

(c) actuating said means for moving the walls to move said bale into a first tie position beyond said discharge end;

(d) actuating said means for tying a bale;

(e) optionally actuating said means for moving the walls to move said bale into a subsequent tie position beyond said discharge end.

9. The method of claim 8, further comprising additional steps of:

(f) actuating said means for moving the walls to eject said bale from said accelerator chamber; and (g) optionally adjusting said width.

* * * * *